United States Patent [19]

Riccardo

[11] Patent Number: 4,913,167

[45] Date of Patent: Apr. 3, 1990

[54] FILTER FITTING MACHINE

[75] Inventor: Mattei Riccardo, Bologna, Italy

[73] Assignee: G.D. Società per Azioni, Bologna, Italy

[21] Appl. No.: 103,896

[22] Filed: Oct. 1, 1987

[30] Foreign Application Priority Data

Oct. 17, 1986 [IT] Italy ..... 3544 A/86

[51] Int. Cl.[4] ..... A24C 1/32; A24C 5/48; A24C 5/58

[52] U.S. Cl. ..... 131/94

[58] Field of Search ..... 131/94

[56] References Cited

U.S. PATENT DOCUMENTS 4,044,779 8/1977 Preston et al. ..... 131/94

4,077,415 3/1978 Preston et al. ..... 131/94

*Primary Examiner*—V. Millin

*Attorney, Agent, or Firm*—Ladas & Parry

[57] ABSTRACT

A filter fitting machine, in which an advancement roller conveys into equidistant sucker seats respective groups each consisting of two cigarette portions separated by a double filter; one edge of a gummed band is made to adhere to each group along the double filter and along part of the two cigarette portions, and is kept in contact with the group by a retention element; a roller provided with equidistant sucker seats then withdraws each group from the advancement roller and feeds it to a rolling station, in which each band is wrapped about the relative group.

3 Claims, 3 Drawing Sheets

FILTER FITTING MACHINE

BACKGROUND OF THE INVENTION

This invention relates to a filter fitting machine. In particular, the invention relates to a filter fitting machine of the type comprising an advancement roller provided with a plurality of peripheral seats each arranged to receive a group consisting of two cigarette portions separated by a double filter, each double filter being joined to the relative cigarette portions by a gummed band which is fed into contact with the double filter and is then wrapped about this latter and about one end of said cigarette portions by rolling the relative group in a rolling station. The continual increase in the production rate of cigarette manufacturing machines has required the construction of increasingly fast filter fitting machines in order to form cigarette production lines in which the outlet of each manufacturing machine can be connected to the inlet of a respective filter fitting machine.

This high-speed operation of filter fitting machines of known type has resulted in a serious problem deriving from the fact that before the rolling operation the said bands adhere to the groups only by one edge, in a "flag" arrangement. The result of this is that because of the high rotational speed of the advancement roller and the consequent high centrifugal force, the bands tend to separate from the groups. When this separation occurs, those groups without a connecting band must be removed. Secondly, those bands which fall off can disturb correct machine operation.

SUMMARY OF THE INVENTION

The operating of the present invention is therefore to provide a filter fitting machine able to operate at an operating speed exceeding that of known filter fitting machines, without the aforesaid drawbacks occurring.

The present invention provides a filter fitting machine comprising an inlet roller provided with a plurality of equidistant peripheral seats for respective groups each consisting of two coaxial cigarette portions separated by a double filter, and a rolling unit for rigidly joining said cigarette portions and said double filter together by means of a gummed band wrapped about said double filter and about the ends of said cigarette portions; said rolling unit comprising conveyor means provided with equidistant support elements for receiving said groups in succession from said inlet roller and for advancing them along a predetermined path, and feed means for feeding a said band into contact with each said group conveyed by a said support element characterized in that said support elements comprise means for retaining said bands in contact with said groups.

DESCRIPTION OF THE PREFERRED EMBODIMENTS

Figure 1:
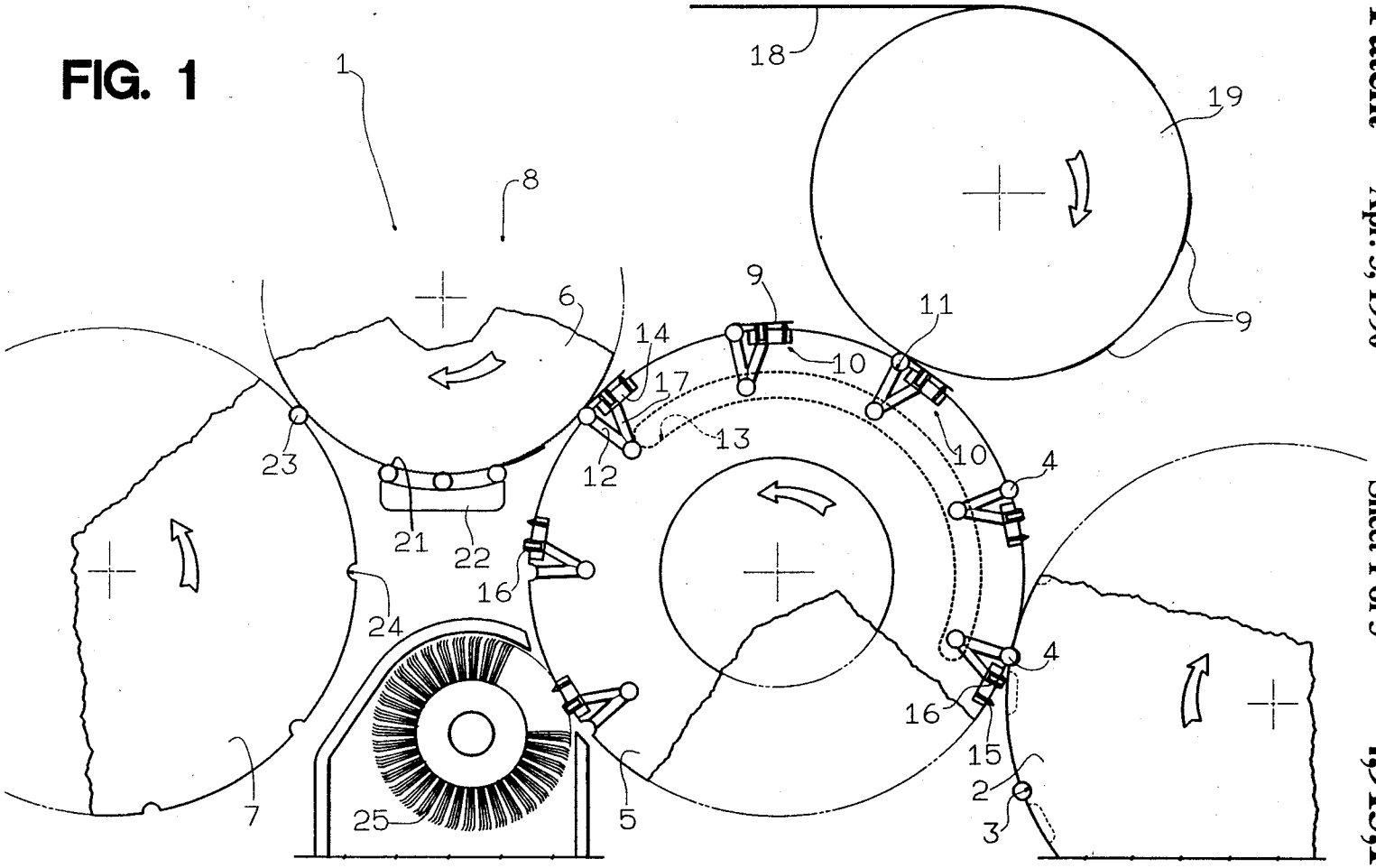
FIG. 1 is a diagrammatic illustration of part of a filter fitting machine constructed in accordance with the present invention.

FIG. 1 shows part of a filter fitting machine, indicated overall by the reference numeral 1.

This part of the machine 1 comprises an inlet roller 2 having a plurality of uniformly distributed peripheral sucker seats 3. Each seat 3 is arranged to receive and retain (in known manner, not shown) a group 4 consisting (in a manner not shown) of two coaxial cigarette portions in contact with a double filter interposed between them.

The roller 2 represents the first of a series of rollers with their axes horizontal and parallel, and arranged to transfer said groups 4 along an operational line and to carry out determined operations on them as described hereinafter. Specifically, the roller 2 is disposed tangential to an advancement roller 5, which hugs a rolling roller 6 which is itself adjacent to an outlet roller 7.

Figures 2, 3:
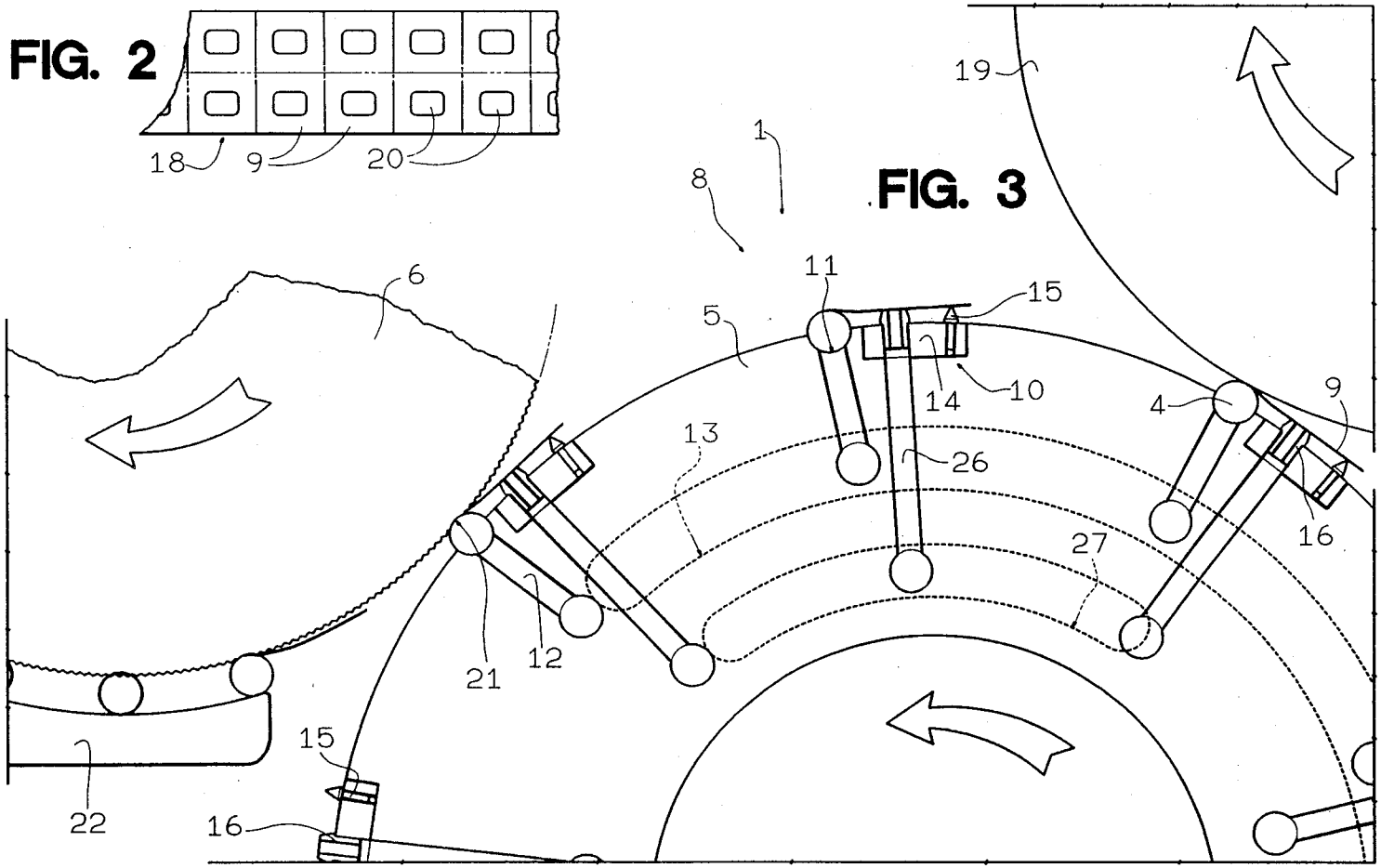
FIG. 2 shows a portion of gummed band forming web suitable for use in a filter fitting machine constructed in accordance with the present invention.
FIGS. 3 and 4 are diagrammatic illustrations to an enlarged scale of two modifications of that part of the filter fitting machine shown in FIG. 1.
Figure 4:
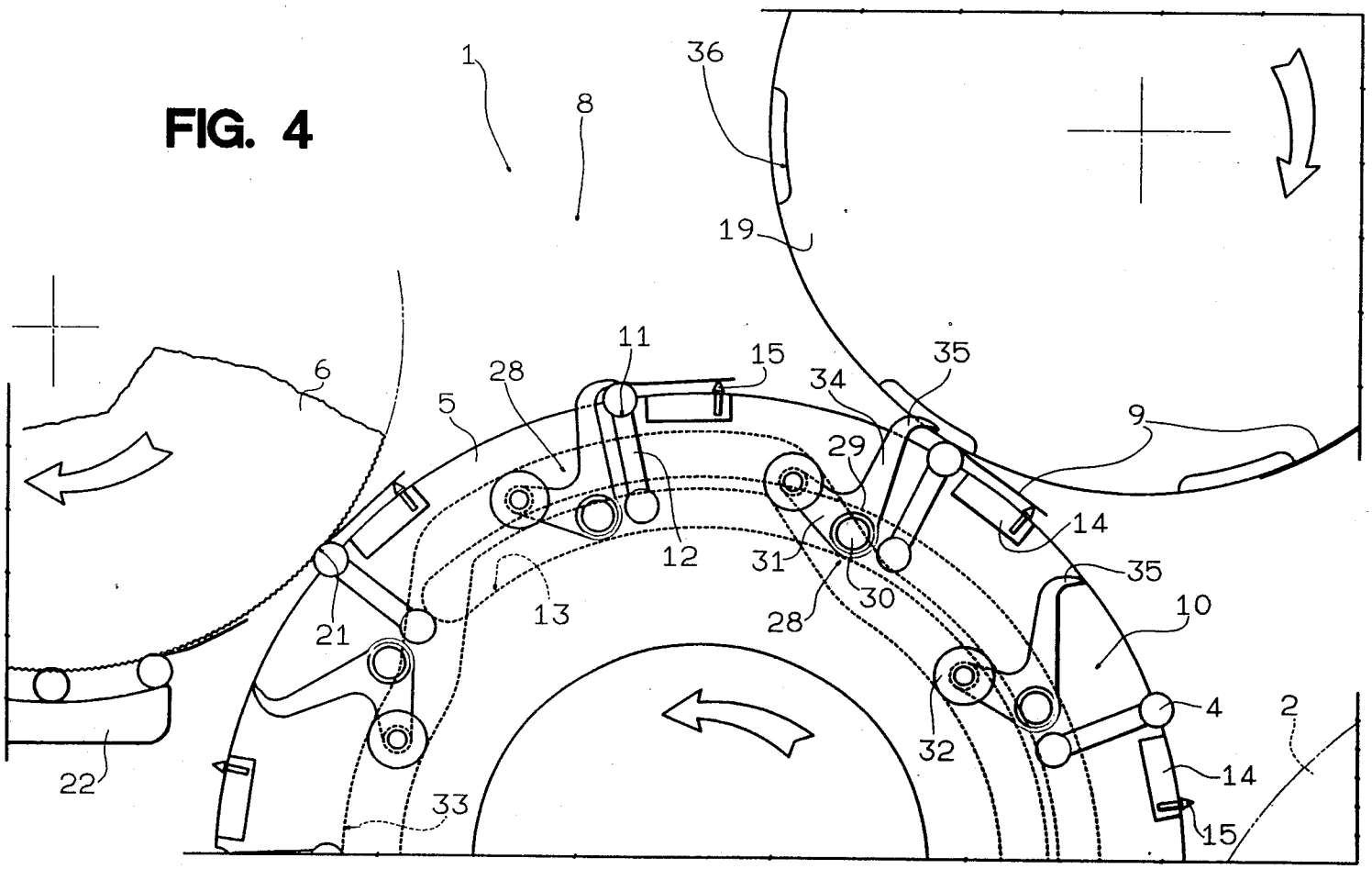

The roller 2 rotates clockwise with respect to FIG. 1, under the action of non-illustrated drive means, whereas the roller 5 rotates anticlockwise and acts as the inlet roller of a rolling unit indicated overall by 8. The rolling unit 8 is arranged to connect together said cigarette portions and said double filter of each group 4 by wrapping a gummed band 9 in known manner about the double filter and about the ends of the cigarette portions adjacent to them. Said roller 5, also defined hereinafter as the conveyor, comprises a plurality of support elements 10 distributed uniformly along its periphery at a pitch equal to that of the seats 3 of roller 2 and arranged to each receive a group 4 and a band 9. Each support element 10 comprises a seat 11 which is formed directly in the periphery of the roller 5 and is arranged to receive a relative group 4 and retain it by suction. As shown in FIGS. 1, 3 and 4, during rotation of the roller 5 each seat 11, over that portion of its path between the regions in which the roller 5 is tangential to the rollers 2 and 6, is connected by a respective duct 12 to a distributor means consisting of an arched slot 13 formed in a fixed portion of the roller 5 and connected in known manner, not shown, to a suction source, also not shown.

Each support element 10 comprises a block 14 which is rigid with the periphery of the roller 5 upstream of the relative seat 11, with respect to the direction of rotation of the roller 5. To each block 14 there is fixed an appendix 15 which extends radially outwards in order to maintain an adhesive surface of the relative band 9 in a position separated from the surface of the roller 5. As shown in FIGS. 1 and 3 each support element 10, in a region of the relative block 14 lying between the seat 11 and the appendix 15, also comprises a retention element consisting of a tubular suction element 16 positioned with its axis radial to the roller 5 and emerging from this latter by a portion of determined length. In the embodiment shown in FIG. 1, each tubular element 16 communicates by a duct 17 with the duct 12 which is connected to the seat 11 adjacent to it, and is therefore able to exert suction along its path between the regions in which the roller 5 is tangential to the rollers 2 and 6.

The bands 9, which are obtained by transversely cutting (in known manner, not shown) a web 18 to one face of which an adhesive material has been applied by gumming means, not shown, are fed in succession to the roller 5 by feed means comprising a feed roller rotatable clockwise with respect to FIG. 1 and substantially tangential to a region of the periphery of the roller 5 which, with reference to the direction of rotation of the roller 5, lies downstream of the region in which the rollers 2 and 5 are mutually tangential. Each band 9 is deposited by the roller 19 on a said group 4 in such a manner that its front gummed edge, with reference to the direction of rotation of the roller 19, is in contact with the group 4, and in addition its intermediate region adheres to the free end of said tubular element 16 and a region close to its rear edge rests on one of said appendices 15. In order to prevent gummed portions of the bands 9 coming into contact with the appendices 15 and with the ends of the tubular elements 16, each band 9 of the web 18 comprises portions 20 without adhesive material, as shown in FIG. 2.

Said roller 6 is positioned tangential to a region of the periphery of the roller 5 which, with reference to the direction of rotation of the roller 5, lies downstream of the point of tangency between the rollers 5 and 19. The roller 6 is provided on its periphery with a plurality of equidistant sucker seats 21, its purpose being to roll the groups 4 in known manner in contact with a rolling bed 22 in a rolling station, so as to wrap and cement the bands 9 about the groups 4, and then to transfer the resultant double cigarettes 23 to relative sucker seats 24 provided in the periphery of the outlet roller 7.

A rotary brush 25 positioned in contact with the peripheral surface of the roller 7 removes any traces of adhesive material deposited on the roller 5 by the gummed bands 9.

When in operation, the groups 4 initially housed in the seats 3 of the inlet roller 2 are transferred in succession, in known manner, into the seats 11 of the roller 5, the peripheral speed of which is equal to that of the roller 2.

Each group 4, retained in a seat 11 by suction, receives a band 9 in passing through the point of tangency between the rollers 5 and 19, and one end of this adheres to the outer periphery of the relative group 4, whereas its second end rests on the free end of the relative appendix 15. An intermediate portion of each band 9, forming part of the band portion 20 free of adhesive material, adheres to the free end of the tubular sucker element 16 provided on the relative support element 10, and is retained in its correct position in contact with the relative group 4.

The groups 4 and bands 9 which partly adhere to them are then transferred in succession into the seats 21 of the roller 6. During their movement in contact with the rolling bed 22, each group 4 rolls on the surface of the roller 6 to the rear of its original seat 21, until it occupies a subsequent seat 21. During the course of this rolling operation, each band 9 is wound about the relative double filter and about one end of the cigarette portions adjacent to it, and each group 4 is therefore transformed into a double cigarette 23, which is then transferred in known manner into a seat 24 of the roller 7.

According to a modification of the present invention shown in FIG. 3, each tubular element 16 communicates by a duct 26 with a distributor means consisting of an arched slot 27 coaxial to the slot 13 and provided in a fixed portion of the roller 5, it being connected in a manner not shown to a suction source, not shown. Said slot 27 extends such as to connect the tubular elements 16 to said suction source from the moment in which the bands 9 are deposited on the groups 4 until the moment in which these latter are given over to the roller 6.

FIG. 4 shows a further modification of the present invention, in which the retention elements for retaining the bands 9 in contact with the groups 4 consist of presser elements 28 associated with each seat 11 containing a group 4.

Each presser element 28 comprises a double-arm lever 29 pivoted on a horizontal pivot 30 supported by the roller 5. An arm 31 of each double-arm level 29 supports with its free end a cam follower element consisting of an idle roller 32 which, as the cam 5 rotates, cooperates with a control means consisting of an annular cam 33 formed in said fixed portion of the roller 5, in order to cause the double-arm lever 29 to rock about the axis of its pivot 30. A second arm 34 of each presser element 28 has a free end positioned adjacent to the peripheral surface of the roller 5 and provided with a tooth 35 shaped and positioned in such a manner as to be able to adhere to the central portion of the relative group 4, to exert pressure against it under the action of the cam 33. Said roller 19 for feeding the bands 9 to the support elements 10 is provided with a plurality of uniformly distributed peripheral cavities 36. The cavities 36 are positioned substantially centred on the generating lines of the roller 19, on which, with respect to the direction of rotation of this latter, the front edges of the bands 9 separated from the web 18 become disposed. When, during the rotation of the roller 5, each support element 10 reaches the region in which the roller 5 and roller 2 are tangential, the relative presser element 28 has rotated anticlockwise about the relative pivot 30 under the action of the cam 33, so that its tooth 35 does not project from the peripheral surface of the roller 5. When a group 4 contained in a seat 11 approaches the line of tangency between the rollers 5 and 19, the presser element 28 is rotated clockwise such that, immediately after transfer of the band 9 onto the group 4, the tooth 35 disposed at the end of the arm 34 comes into contact with the edge of the band 9 adhering to the group 4, and keeps it adhering to the group 4 during the course of its further movement towards the roller 6. Said cavities 36 of the roller 19 enable the presser elements 29 to undergo said rotation without interference occurring between the teeth 35 and the peripheral surface of the roller 19.

At a moment immediately before each group 4 reaches the region of mutual tangency of the rollers 5 and 6, the cam 33 causes the presser element 28 relative to said group 4 to undergo anticlockwise rotation in order to allow the group 4 to pass from the roller 5 to the roller 6. After this passage, each presser element 28 remains with its tooth 35 lying below the peripheral surface of the roller 5 until it returns into proximity to the roller 19 and reverts to its previously stated attitude. From the aforegoing it can be seen that by using the descried retention elements 16 or 28, all the stated drawbacks of filter fitting machines of known type are obviated, in that the bands 9 are held with their edge in contact with the groups 4 as they move towards the rolling roller 6, and can therefore not become detached from the groups 4.

What I claim is:

1. A filter fitting machine comprising:

in inlet roller;

equidistant peripheral seats on said inlet roller, each of said seats being capable of receiving and retaining by suction a group consisting of two coaxial cigarette portions separated by a double filter;

a rolling unit comprising conveyor means, a rolling roller, and a rolling bed, said conveyor means comprising an advancement roller rotatable about an axis parallel to the axis of rotation of said inlet roller, said rolling roller being located substantially tangentially to said advancement roller and cooperating with said rolling bed for wrapping said band about an intermediate portion of each of said group;

support elements peripherally and equidistantly provided on said conveyor means and being capable of receiving one of said groups fed by said inlet roller and thereby advancing said received group along a determined path, said support elements each comprising a suction seat and an appendix positioned apart from said suction seat and extending outwardly from said advancement roller to support one end of said band;

feed means for feeding a gummed band into contact with each of said groups carried by said support elements;

retaining means associated with said support elements for retaining one each of said bands in contact with one each of said group, said retaining means comprising in each support element a suction element positioned between said suction seat and said appendix; and an air flow distributor means and a suction air source connected to said air flow distributor means, said air flow distributor means communicating with said suction elements, wherein said air flow distributor means are located along that portion of the path of said groups lying between the position in which said advancement roller is tangential to said feed means and the position in which said advancement roller is tangential to said rolling roller.

2. A filter fitting machine comprising:

an inlet roller;

equidistant peripheral seats on said inlet roller, each of said seats being capable of receiving and retaining by suction a group consisting of two coaxial cigarette portions separated by a double filter;

a rolling unit comprising conveyor means, a rolling roller, and a rolling bed, said conveyor means comprising an advancement roller rotatable about an axis parallel to the axis of rotation of said inlet roller, said rolling roller being located substantially tangentially to said advancement roller and cooperating with said rolling bed for wrapping said band about an intermediate portion of each of said group;

support elements peripherally and equidistantly provided on said conveyor means and being capable of receiving one of said groups fed by said inlet roller and thereby advancing said received group along a determined path, said support elements each comprising a suction seat and an appendix positioned apart from said suction seat and extending outwardly from said advancement roller to support one end of said band;

feed means for feeding a gummed band into contact with each of said groups carried by said support elements;

retaining means associated with said support elements for retaining one each of said bands in contact with one each of said group, said retaining means comprising in each support element a presser element which is moveable between a first position wherein said presser element rests against one of said bands disposed in contact with one of said groups and a second position disengaged from one of said bands; the filter fitting machine further comprising control means provided to move said presser elements between said first and second positions; and an air flow distributor means and a suction air source connected to said air flow distributor means, said air flow distributor means communicating with said suction seat of said support elements elements, wherein said air flow distributor means are located along that portion of the path of said groups lying between the position in which said advancement roller is tangential to said feed means and the position in which said advancement roller is tangential to said rolling roller.

3. The filter fitting machine of claim 2 wherein said control means comprises a cam means and wherein said pressure element comprises a double-armed lever pivoted on a pivot supported by said advancement roller, a first arm of said double arm lever supporting a cam follower element disposed in engagement with said cam means, the second arm of said double-arm lever being provided with a tooth for pressing one of said bands against one of said groups.

* * * * *